United States Patent [19]

Hoffman et al.

[11] Patent Number: 4,677,777

[45] Date of Patent: Jul. 7, 1987

[54] PRICE SETTING AND DISPLAY SYSTEM FOR MULTIPLE UNIT MERCHANDISING MACHINE

[75] Inventors: David Hoffman, Hillsdale, N.J.; Lee C. Verduin; Ross Ouwinga, both of Grand Rapids, Mich.

[73] Assignee: Rowe International, Inc., Whippany, N.J.

[21] Appl. No.: 731,967

[22] Filed: May 8, 1985

[51] Int. Cl.[4] ..... G09F 19/04

[52] U.S. Cl. ..... 40/460; 40/5; 40/312

[58] Field of Search ..... 40/5, 312, 460, 447; 214/16.4

[56] References Cited

U.S. PATENT DOCUMENTS 3,297,927 1/1967 Blakeslee et al. ..... 40/466

3,678,282 7/1972 Johnson ..... 40/466

4,002,886 1/1977 Sundelin ..... 40/466

*Primary Examiner*—Gene Mancene

*Assistant Examiner*—Wenceslao J. Contreras

*Attorney, Agent, or Firm*—Shenier & O'Connor

[57] ABSTRACT

An improved price display system for a multi-level merchandising machine in which the prices of articles at the respective levels are electronically displayed individually at locations immediately adjacent to the levels. Both the prices and the displays can be changed in a rapid and expeditious manner from a station within the machine cabinet. In addition, both the mode of operation and the compartment size of a level can be displayed and changed. The system may be provided with a timer for automatically changing all prices at a predetermined time. The system employs a small number of conductors to control a large number of displays.

10 Claims, 6 Drawing Figures

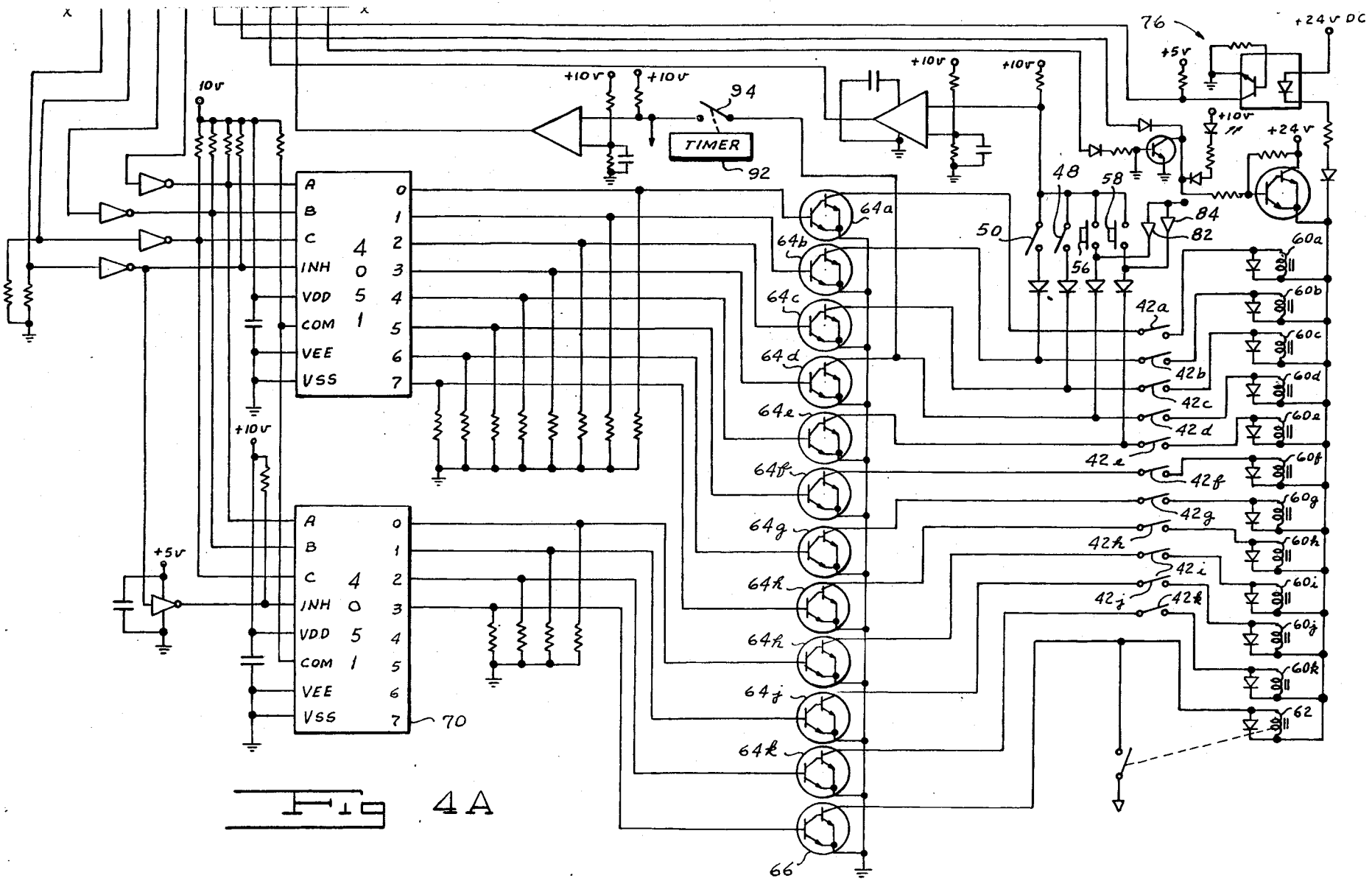
4A
FIG.

PRICE SETTING AND DISPLAY SYSTEM FOR MULTIPLE UNIT MERCHANDISING MACHINE

FIELD OF THE INVENTION

The invention is in the field of multi-unit merchandising machines and, more particularly, to an improved price display system for such a machine.

BACKGROUND OF THE INVENTION

There are known in the prior art merchandising machines which are adapted to deliver articles of merchandise from respective units, each of which delivers its articles in return for the deposit in the machine of money aggregating the price at which articles in that unit are to be sold. One example of a merchandising machine of this type is disclosed in U.S. Pat. No. 4,317,604 issued Mar. 2, 1982 to Merrill Krakauer. In that machine the delivery or dispensing units are represented by the various levels of a drum which rotates about a vertical axis to carry compartments of the respective levels past normally closed doors in the front of the machine. In the course of a dispensing operation upon the deposit in the machine of money aggregating the purchase price of an article at a level, a door unlocking solenoid at that level is adapted to be energized upon the initiation of an opening movement of the door to be moved to a fully open position to afford access to a compartment behind the door. The machine shown in this patent is provided with an arrangement for doubling the number of compartments at a level, while at the same time reducing the size of each compartment by a half. U.S. Pat. No. 4,391,388 issued July 5, 1983 to Merrill Krakauer, discloses an improved control system for the machine shown in the Krakauer '604 patent which permits each level of the machine to be set to operate in either a "shopper" mode or in a "FIFO" mode. As is known in the art, in the "shopper" mode the articles at the level are depleted in the order in which they are selected by the customer. In the "FIFO" mode of operation the articles are delivered or dispensed only in a predetermined order.

In use of the machines of the type described hereinabove, some means was provided for indicating the price at which an article of merchandise in a particular level was sold. Such indicators may, for example, be price indicators of the type commonly employed in food markets to display the prices of the various articles of merchandise. It will readily be appreciated that changing these price displays is a relatively time consuming and cumbersome operation.

The desirability of selling perishable articles such as platters of food or the like at a reduced price later in the day at the plant or the like in which the merchandising machine is installed will be obvious. Machines of the prior art are not readily adapted to such an operation. First, they usually require a serviceman to change the prices. Moreover, where the prices are changed the price indications at the various levels must be correspondingly changed. Where this operation must be performed by a serviceman, the benefits gained from selling the articles at reduced prices are more than outweighed by the cost of the serviceman's time.

SUMMARY OF THE INVENTION

One object of our invention is to provide an improved price display system for a multi-unit merchandising machine.

Another object of our invention is to provide an electronic price display positioned adjacent the merchandising unit with which it is associated and which may be changed from a central location.

A further object of our invention is to provide a pricing system for a multi-unit merchandising machine in which both the prices and the price displays can be rapidly and expeditiously changed from a central location.

A still further object of our invention is to provide a price setting and display system which substantially eliminates the possibility of error between the price displayed and the price at which an article is sold.

Still another object of our invention is to provide a display which permits not only the price at which articles of a unit are to be sold, but also the mode of operation and compartment size of the unit to be displayed.

Yet another object of our invention is to provide a pricing system which automatically changes both the prices at which the various units sell articles and the corresponding displays to change automatically at a predetermined time.

Another object of our invention is to provide a multi-unit price display system in which a relatively small number of conductors are used to control a large number of displays.

Other and further objects of our invention will appear from the following description.

BRIEF DESCRIPTION OF THE DRAWINGS

In the accompanying drawings to which reference is to be made in the instant specification and which are to be read in conjunction therewith and in which like reference characters are used to indicate like parts in the various views:

FIG. 4A is a schematic view of a portion of the electrical circuitry of our improved price display system for a multi-level merchandising machine.

DESCRIPTION OF THE PREFERRED EMBODIMENT

Figure 1:
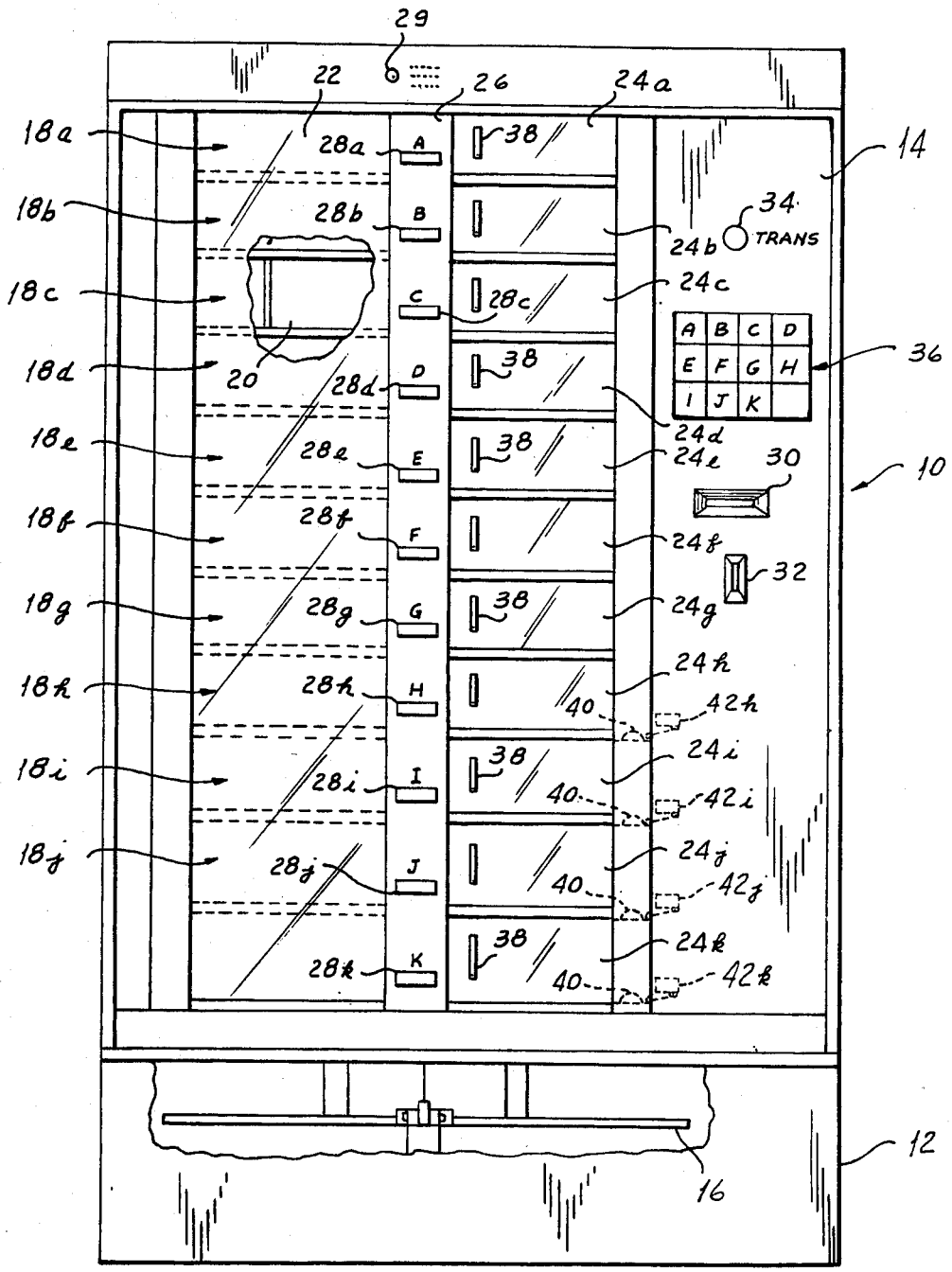
FIG. 1 is a front elevation of one form of merchandising machine provided with our improved price display system.

Referring now to FIG. 1 of the drawings, one type of merchandising machine indicated generally by the reference character 10, which may be provided by our improved price display system includes a cabinet 12 provided with a door 14 which is normally closed over the cabinet front. A drum 16 supported for movement around a vertical axis within the cabinet 12 includes a plurality of levels 18*a* to 18*k*, each of which comprises a plurality of compartments 20 from which articles of merchandise are adapted to be dispensed. The machine 10 may, for example, be of the type disclosed in Krakauer U.S. Pat. No. 4,317,604 referred to hereinabove. The door 14 has a window 22 which extends through the height of all of the compartments 18*a* to 18*k* permit articles of merchandise in the compartments to be viewed by a potential customer. Adjacent to the window 22 are a plurality of access doors 24*a* to 24*k* arranged in vertical superimposed relationship. A vertically extending panel 26 disposed between the window 22 and the column of doors 24 is provided with a plurality of displays 28*a* through 28*k* corresponding to the number of drum levels and positioned respectively at locations at which they are associated with the levels. If the customer has established sufficient credit but the selected compartment is not aligned with the associated door, a lamp 29 will flash when he attempts to open the door to call attention to a legend saying "Rotate drum to proper position" or the like. If the customer attempts to make a purchase when insufficient credit has been established, the price display will flash when he attempts to open the door, thus alerting the customer to the fact that there is insufficient credit.

A door 14 also supports a bill support 30 through which bills are adapted to be inserted into a suitable bill acceptor. A coin slot 32 is adapted to receive coins. A transport button 34 is adapted to be actuated to rotate the drum 16 to move all of the articles past the window 22 to permit them to be viewed by a potential customer. A pushbutton array, indicated generally by the reference character 36 includes a number of pushbuttons A through K corresponding to the available selections in the machine. As will be explained more fully hereinbelow, each level of the machine may be set alternatively to deliver its articles in a first-in, first-out mode or in a shopper mode. If the particular level is set to dispense articles in a first-in, first-out mode, actuation of one of the pushbuttons of the array 36 corresponding to that level will cause the drum 16 to move through the space of one compartment. If, on the other hand, the selected level is to dispense articles in the shopper mode, actuation of the pushbutton of the array 36 corresponding to that level will result in a rotation of the drum 16 as long as the button is depressed. The button may be released to position the desired article of merchandise on the selected level behind its associated access door.

Each of the doors 24*a* to 24*k* is provided with a handle 38 which is adapted to be operated to slide the door to the right as viewed in FIG. 1. After a limited movement of the door, a cam 40 actuates one of a number of door unlocking solenoid switches 42*a* to 42*k*. If a sum of money aggregating at least a purchase price of the selected article has been deposited in the machine, upon actuation of the switch 42 the corresponding door unlocking solenoid will be energized to release the door to permit it to be moved to the fully open position. This action is more fully explained in the Krakauer patent discussed hereinabove. It will readily be appreciated that if the selected level has only half size compartments the fully open position of the door would be only half what it would be if the compartments were full size.

Figure 2:
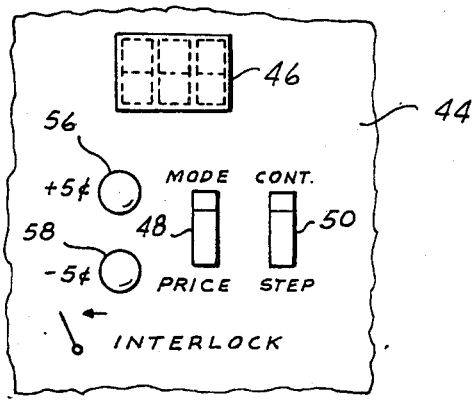
FIG. 2 is a fragmentary view of the interior control panel of the machine illustrated in FIG. 1.

Referring now to FIG. 2, the interior of the cabinet 12 supports a control panel 44 located behind that portion of the door which supports the pushbutton array 36. Panel 44 provides the main display 46, as well as two DIP switches 48 and 50. Switch 48 is adapted to be set alternatively to permit either the mode of operation of a particular level or the price at which an article at the level is sold to be set. The switch 50 can be set to permit the drum 16 to move step by step in response to operation of a transport button or to cause it to rotate continuously upon operation of a transport button. Panel 44 also supports door interlock switch 54 and respective pushbuttons 56 and 58. Pushbutton 56 is adapted to be operated to increment price in 5 cent steps when the switch 48 is set to permit a price change to be made. Switch 58 decrements the price in 5 cent steps when switch 48 is set for a price change. With switch 48 set to "mode" button 56 may be actuated to toggle between "shopper" and "FIFO" and switch 58 may be actuated to toggle between large and small size compartments.

Figure 4B:
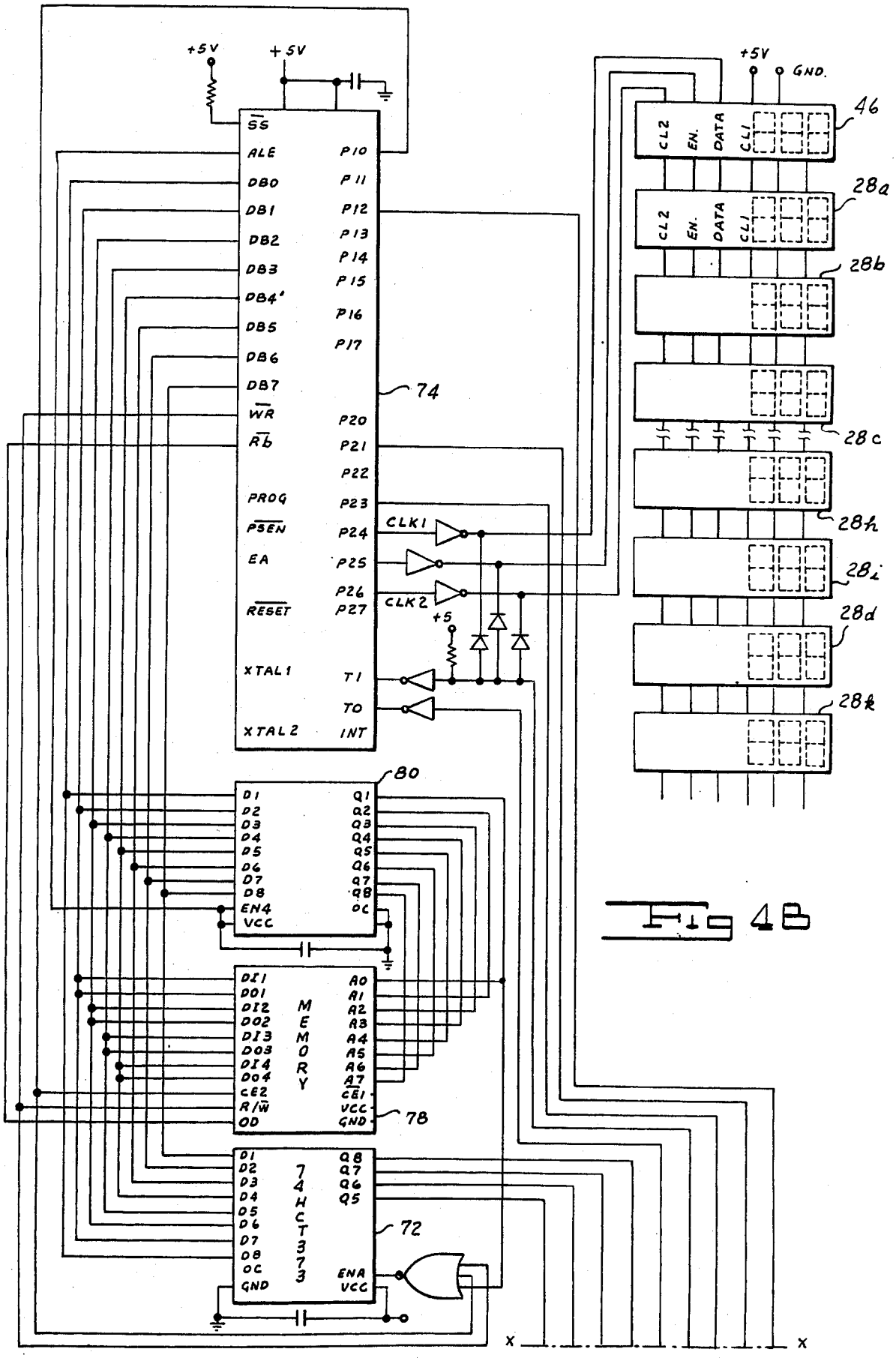
FIG. 4B is a schematic view of another portion of the electrical circuitry of our improved price display system for a multi-level merchandising machine.

Referring now to FIGS. 4A and 4B, the switches 42*a* to 42*k* connect corresponding sides of the door unlock solenoids 60*a* to 60*k* to transistors 64*a* to 64*k*. The corresponding side of the cabinet door lock solenoid 62 is connected to a transistor 66. Transistors 64*a* to 64*k* and 66 are connected to multiplexers or strobes coupled to a decoder 72 which feeds a microprocessor 74, such for example as in Intel 8050. A voltage supply circuit, indicated generally by the reference character 76, connected between the other sides of the respective door unlocking solenoids 60*a* to 60*k* and the ports P12, T1 and T0 of the microprocessor 74 is actuated to supply either a signalling voltage or an energizing voltage to the solenoids.

A memory 74 adapted to store two sets of prices and a decoder 76 complete the portion of the control circuit which is germane to our invention.

In operation of the portion of the circuitry thus far described, with the cabinet door 14 closed and with sufficient money credited in the machine, the customer may make a selection by moving the door 24 in front of the selected article to the right. Under these conditions circuit 76 will be actuated so as to supply sufficient voltage to the solenoid 60 corresponding to the selection to energize the solenoid to free the door to be fully open for access to the article being purchased. However, as will be described more fully hereinbelow, when the cabinet door 14 is open, as when a price is being set and movement of one of the doors to its open position is initiated, closure of the corresponding switch 42*a* causes a pulse to be applied through one of the transistors 64*a* which is sufficient to indicate through the appropriate circuitry that one of the levels and its corresponding display has been selected for a price change, for example. It will be appreciated that in the course of this operation, the voltage which passes through the solenoid 60 is not sufficient to energize the solenoid.

We provide the control panel 44 with a pair of LEDS which, as will be described hereinbelow, glow when the buttons 56 and 58 are pushed. Microprocessor 74 puts out clock pulses on a CLK1 line, 86, to clock in the data which is to be displayed. A second line, 88, carries the data which is to be displayed. A third line, 90, provides a second clock input CLK2 which selects among the main display 46 and the individual level displays 28*a* to 28*k* to determine which of these is active.

Figure 3:
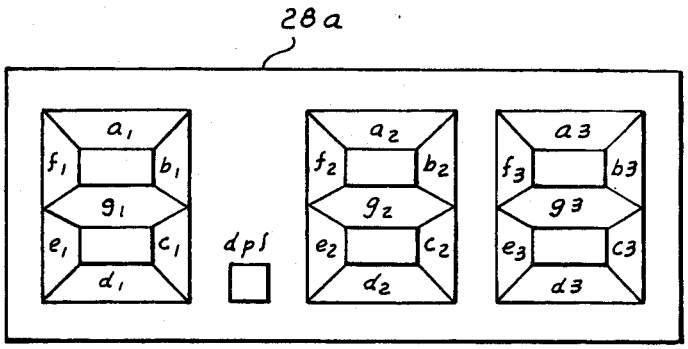
FIG. 3 is a front elevation of one of the display units of our improved price display system for a multi-level merchandising machine.

Referring now to FIG. 3, each of the displays such as the main display 46 and the individual displays 28, comprises three arrays of seven segments each which may selectively be energized to form 0 and the numerals 1 to 9, as well as the letters "F" and "S" to indicate "FIFO" or "shopper", as well as the letters "L" and "S" to indicate large or small. By way of example, we have identified the segments of the three digits respectively as a1 to g1, a2 to g2, and a3 to g3 in FIG. 3. The display also includes a decimal point indicator dp1.

In order to set the prices, the coin mechanism compartment door switch must be open and the switch 48 moved to its open position corresponding to a price change. Next, either of the two buttons, 54 or 58, is pushed to cause the diodes 82 and 84 to glow to indicate that the machine is in a price setting mode. In one particular arrangement the program is set to automatically enable the price setting and the price display of selection A as soon as the price setting mode is entered. If the operator wishes to change the price of selection A, he merely pushes button 56 to increment the price of selection A in five cent increments or to decrement the price of selection A in five cent decrements by pushing button 58. The price being changed is shown, not only on the display 28 adjacent to that level, but also on the main display 46.

If the operator wishes to change the price of a different selection, he slides the associated door to the right to actuate the corresponding switch 42. The microprocessor 74 then identifies the particular level and puts out pulses on line 90 which sequentially activate the displays **28*a* through 28*k* until the selected display is reached. When the selected display is reached, and upon operation of the buttons 56 and 58, that price will be incremented or decremented. If the operator holds one of the pushbuttons down continuously the price will be incremented or decremented at a very rapid rate. It will be as fast as the computer can go. As soon as the button is released it stops. If the operator decrements the price, it will go all the way down to 0 and then stop at 0. If, on the other hand, the price is being incremented, it will go as high as $9.95 and then flip over to 0. The arrangement is such that when the machine powers up for the very first time with nothing in the memory 78**, it powers up with all prices set at $9.95. Since most of the prices are considerably lower than that, it is much faster to increment the price and permit it to flip over to 0 and begin from there. That is the reason why the feature of flipping over is provided for price incrementing.

Figure 5:
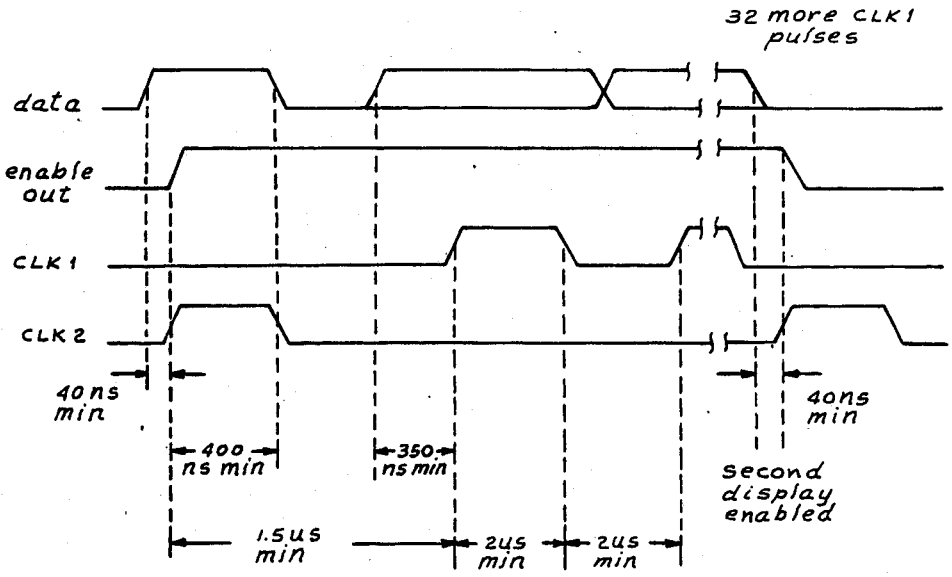
FIG. 5 is a diagrammatic view of the wave forms in a portion of the circuitry shown in FIG. 4.

As has been pointed out hereinabove, in order to select which of the displays 28 is to be set, the operator moves the door 24 corresponding to that display to actuate the associated switch 42. As a result, the corresponding display 28 is energized in the following manner. Each one of the display boards 28 has a flip-flop. Initially a "1" is set up on data line 88 and line 90 is clocked once to enable the main display. The "1" is then taken off the data line and line 90 is clocked a number of times corresponding to the display desired. For example, if the operator wishes to set the price for selection D, the line 90 is clocked five times. In this way, while the data is being sent to all of the displays at the same time, it is only being clocked into the enabled display. In this mamnner we achieve the control of a large number of displays by using only three lines. It will readily be appreciated by those skilled in the art that normally 12 lines would be needed to control all 12 displays. The resultant space saving is significant in an installation of the type to which our system is applied in which the displays are arranged in vertically spaced relationship along a relatively narrow member 26 between the transparent window 22 and the transparent doors 24. We have shown the pulse trains appearing on lines 86, 88 and 90 in FIG. 5.

We provide our system with means for automatically resetting all of the prices at a predetermined time, such as, for example, relatively late in the day at the plant or the like in which the machine is installed. In this way left over merchandise will be reduced. A timer 92 of any suitable type known to the art, closes a switch 94 at the time set. As long as the switch 94 is closed, the second set of prices is displayed and used. The prices of the second set may be changed using the same technique as that described hereinabove in connection with the first set, except that the switch 94 is closed during the setting of the second set of prices.

In our system it is possible readily to change the mode of operation of any level between "shopper" and "FIFO" and to change the size of the compartment. This is accomplished by placing switch 48 in the "on" position. When that is done the status of each selection or level will be displayed on the price display. In such a display, the character corresponding to the most significant digit of the price will be either an "S" to indicate "shopper" mode or an "F" to indicate the "FIFO" mode. The character corresponding to the least significant digit of the price will be "S" for a small compartment or "L" for a large compartment. To change the status of any level, the corresponding door 24 first is moved to the right. Then the button 56 is pressed to toggle between "FIFO" and "shopper". The size pushbutton 58 may be pushed to toggle between large and small compartment size.

To exit either of the price change conditions or mode setting conditions, the two pushbuttons can be pushed simultaneously for two seconds or the coin mechanism compartment door can be closed to automatically restore the machine to the "vend" condition.

It will be seen that we have accomplished the objects of our invention. We have provided an improved price display system for a multi-unit merchandising machine. We have provided an electronic price display positioned adjacent the merchandising unit with which it is associated and which may be changed from a central location. In our system both the prices and the price displays can be rapidly and expeditiously changed from the central location. Our arrangement permits display of the price at which a unit sells articles, the mode of operation of the unit, and the compartment size of the unit. We have provided a pricing system in which the prices at which the various units sell articles are automatically changed at a predetermined time. Our arrangement permits of the control of a large number of displays with a minimum number of conductors.

It will be understood that certain features and subcombinations are of utility and may be employed without reference to other features and subcombinations. This is contemplated by and is within the scope of our claims. It is further obvious that various changes may be made in details within the scope of our claims without departing from the spirit of our invention. It is, therefore, to be understood that our invention is not to be limited to the specific details shown and described.

Having thus described our invention, what we claim is:

1. A price setting and display system for a mechandising machine adapted to sell articles of merchandise from a plurality of dispensing units at various prices, said units being disposed at spaced locations in a cabinet having a door, said cabinet with said door closed affording a view of said units while preventing access thereto, said system including a plurality of individual displays, means mounting said displays on said machine at respective positions adjacent to said locations and visiable to a potential customer with the door closed, normally disabled means at a central location within said cabinet for setting prices for said units and for actuating said displays in accordance with prices at which articles are to be sold and means responsive to opening of said cabinet door for concomitantly disabling said units and enabling said normally disabled means.

2. A display system as in claim 1 including a first switch for incrementing the price and a second switch for decrementing the price.

3. A system as in claim 1 including means for storing two sets of prices for said units, and means for controlling said display means alternatively to display said two sets of prices.

4. A system as in claim 3 in which said controlling means includes means for normally displaying said first set of prices, switch means adapted to be closed to cause the second set of prices to be displayed and timer means for closing said switch means.

5. A system as in claim 4 in which said setting and actuating means is adapted to change said second set of prices when said switch is closed.

6. Apparatus as in claim 1 in which said machine comprises a plurality of access doors associated with said levels, said setting and actuating means including means responsive to movement of said doors toward open position for selecting among said displays.

7. In a merchandising machine having a cabinet and a plurality of article dispensing units positioned at spaced locations in said cabinet, each of said dispensing units having a manually operable element associated therewith, price display apparatus including a plurality of individual electronic displays, means mounting said displays in positions respectively adjacent to said locations at which a potential customer viewing the displays immediately associates them with the respective units, means for simultaneously feeding price data to all of said displays, and means responsive to actuation of one of said manually operable elements for selectively enabling the corresponding dispay to receive said price data.

8. Apparatus as in claim 7 in which said means for simultaneously feeding price data includes a data line and said enabling means comprises first and second clock lines.

9. In a merchandising machine having a plurality of article dispensing units adapted to dispense articles of merchandise at various prices, pricing apparatus including means for storing two sets of prices for said units, means normally setting said units to sell at the first set of prices, and timer means for automatically setting said units to sell at the second set of prices at a predetermined time.

10. A system as in claim 1 including a power circuit for each of said units and a control circuit for each of said displays, the power circuit of a unit and the control circuit for the corresponding display comprising a common element.

* * * * *

Disclaimer 4,677,777.—*David Hoffman*, Hillsdale, N.J., *Lee C. Verduin* and *Ross Ouwinga*, both of Grand Rapids, Mich. PRICE SETTING AND DISPLAY SYSTEM FOR MULTIPLE UNIT MERCHANDISING MACHINE. Patent dated July 7, 1987. Disclaimer filed Mar. 6, 1989, by the assignee, Rowe International, Inc.

Hereby enters this disclaimer to claim 9 of said patent.

[*Official Gazette May 9, 1989* ]